United States Patent [19]

Aebersold

[11] Patent Number: 4,964,361

[45] Date of Patent: Oct. 23, 1990

[54] DEVICE FOR VARNISHING THE INSIDE HOLLOW BODIES

[75] Inventor: Rene Aebersold, Villars-sur-Glane, Switzerland

[73] Assignee: Polytype AG, Fribourg, Switzerland

[21] Appl. No.: 192,384

[22] Filed: May 10, 1988

[30] Foreign Application Priority Data

May 13, 1987 [DE] Fed. Rep. of Germany ..... 3715969

[51] Int. Cl.[5] ..... B05B 15/02

[52] U.S. Cl. ..... 118/302; 118/313; 118/314; 118/317; 118/319

[58] Field of Search ..... 118/302, 313, 317–321, 118/323, DIG. 10; 134/22.12

[56] References Cited

U.S. PATENT DOCUMENTS

| | | | |
|---|---|---|---|
| 3,062,177 | 11/1962 | Henrickson | 118/318 |
| 3,379,173 | 4/1968 | Szczepanski | 118/319 |
| 3,741,150 | 6/1973 | Napor et al. | 118/302 |
| 3,792,681 | 2/1974 | Jones et al. | 118/319 |
| 3,977,358 | 8/1976 | Stroobants | 118/318 |
| 4,246,300 | 1/1981 | Jensen | 118/318 |
| 4,475,479 | 10/1984 | Rinck et al. | 118/318 |
| 4,830,882 | 5/1989 | Ichinose et al. | 118/302 |

FOREIGN PATENT DOCUMENTS 2502030 9/1982 France .

*Primary Examiner*—James C. Housel
*Attorney, Agent, or Firm*—McGlew and Tuttle

[57] ABSTRACT

A spraying nozzle of an installation for varnishing hollow bodies from their interiors and especially for varnishing metallic tubes or cans are connected with a spraying nozzle supporting device by a pivotal joint. In the driven out position of the supporting device when the nozzles are out of the hollow bodies, the spraying nozzles can be rotated through an angle and positioned in a tubular clearing device of a purification plant. The article to be sprayed and the spray nozzle are arranged so that the nozzles and the article may be moved relatively to cause the nozzle to enter into the article and move along its interior and spray the article interior as relative movement between the article and the nozzle is carried out and the nozzle and the article, and a cleaning apparatus are arranged so that the nozzle and the article can move relatively for drawing the nozzle out of the article and they can be shifted relatively through an angle and positioned into cooperative engagement with the cleaning apparatus.

7 Claims, 6 Drawing Sheets

DEVICE FOR VARNISHING THE INSIDE HOLLOW BODIES

FIELD AND BACKGROUND OF THE INVENTION

This invention relates in general to a method and apparatus for coating hollow articles on their interiors and in particular to a new and useful method for varnishing the interior of metallic tubes and cans.

The invention relates particularly to a device for varnishing hollow bodies from inside, especially metallic tubes or cans. The tubes or cans are supplied continuously by means of a delivery system through a handing over station of a revolving drum. They are guided past a unit which varnishes inside spaces and it includes a spraying nozzle device, upon which a number of spraying nozzles are disposed. The nozzles extend into the hollow bodies and they can be slid along so as to be guided afterwards into a guiding-away system through a receiving head end.

Such devices for varnishing hollow bodies from inside are known and are delivered for example by the firm Sprimag GmbH, D-7312 Kirchheim-Teck under designations such as HIL-26, HIL-28. The hollow bodies which are twisted on the drum, receive the varnish layer by the fact that the spraying nozzles submerge into the hollow bodies. The spray nozzle support, on which the spray nozzles are attached, follows the turning of the drum supporting the hollow bodies. This occurs during a working phase, when the spraying nozzles are submerged into the hollow bodies. During the extraction of the spraying nozzles out of the hollow bodies the varnish is sprayed onto the inner surface of the hollow bodies.

The quantity of varnish flowing through is adjusted as a function of the twisting speed of the spraying nozzles and thus an even layer of varnish showing the desired thickness can be obtained. A duplex procedure is used for varnishing hollow bodies from inside. That means that always two spraying nozzles carry out one identical working process, and thus always two hollow bodies are varnished together. Thus for varnishes to be sprayed on in two layers, four spraying nozzles are necessary. It is possible as well to lead the hollow bodies, which have received a varnish layer, away from the drum by means of a take-off station after the two spraying nozzles pass through. They are then directed through a drying furnace and then back onto the drum for a second varnish layer applied by the third or fourth spraying nozzle.

In the case of such installations for varnishing hollow bodies from inside, it is inevitable, that the spraying causes a fog of varnish. This fog of varnish is sucked off by suction devices disposed outside of the area through which the hollow bodies are moved.

This avoids an exceeding pollution of the machine parts next to the varnishing device by a fog of varnish which would settle down on them. However, the spraying nozzles, which move continuously in the fog of varnish nevertheless are polluted in a very short time, so that the good quality of the varnish layer is not guaranteed, because the pollution can hinder the varnish from leaving the spraying nozzle. In order not to incur the risk of losing quality, the spraying nozzles have to be cleaned regularly with a certain frequency. For this end the installation is switched off, the spraying nozzles are brought into the position in which they would extend from the hollow bodies and then each individual spraying nozzle has to be cleaned by hand. This requires a workman who frees the spraying nozzles, which is very difficult because they are washable. This results in the installation being out of service for a very long time.

SUMMARY OF THE INVENTION

The invention includes spraying nozzles arranged onto a spraying nozzle support in such a way, that they can be brought into an easily accessible position for the necessary cleaning, and to carry out this cleaning of the spraying nozzles by an entirely automatic purification plant.

Pursuant to the invention, the spraying nozzles are connected to the spraying nozzles support by means of a joint and they can be swivelled away in the driven-out position of the spraying nozzle support from the area of a drum bearing the hollow bodies and come into the operating area of a purification plant.

By swiveling the spray nozzles from the horizontal working position into the vertical position, a good accessability to the spraying nozzles is obtained for cleaning. By disposing the spraying nozzles in an area below the drum, which leads the hollow bodies past the spraying nozzles, a pollution of the machine parts next to this area can be largely prevented, because the produced fog of varnish settles down. No problems of space are caused for the arrangement of an automatic purification or cleaning plant either.

It is advantageous, if the spraying nozzles are directed vertically towards the bottom for cleaning by the purification plant, because the used purification materials drop during the cleaning process and can be lead off to the collecting sink without any problem.

Especially with an automatic purification plant, the shutdown time of the installation can be cut considerably, because all the spraying nozzles are cleaned together.

Accordingly it is an object of the invention to provide a method of spraying the interior of hollow articles in order to coat them with a material and using a spray nozzle in a cleaning apparatus, comprising arranging the article to be sprayed and the spray nozzle so that the spray nozzle and the article may be moved relatively to cause the nozzle to be positioned along the length of the interior of the article, terminating the spray from the nozzle and affecting the relative movement between the article and the nozzle to position the nozzle outside of the article, arranging the nozzle, the article and the cleaning apparatus so that the nozzle can be moved out of the article shifted through an angle positioned into cooperative engagement with the cleaning apparatus.

A further object of the invention is to provide a device for spraying the interior of articles which includes a support for a hollow element alongside a mounting means for a nozzle support which pivotally mounts a spray nozzle on a lever member which is pivotally mounted on the mounting device, the mounting device being movable with the nozzle from a spray position extending parallel to the hollow element and to a cleaning position which it extends at an angle to the spray position which also includes cleaning means which are mounted so that movement between the nozzle and the cleaning means may be affected to carry out a positioning of the nozzle in association with the cleaning means for cleaning.

A further object of the invention is to provide a spraying device which is simple in design, rugged in construction and economical to manufacture.

The various features of novelty which characterize the invention are pointed out with particularity in the claims annexed to and forming a part of this disclosure. For a better understanding of the invention, its operating advantages and specific objects obtained by its uses, reference is made to the accompanying drawings and descriptive matter in which preferred embodiments of the invention are illustrated.

GENERAL DESCRIPTION OF THE PREFERRED EMBODIMENTS

Figure 3:
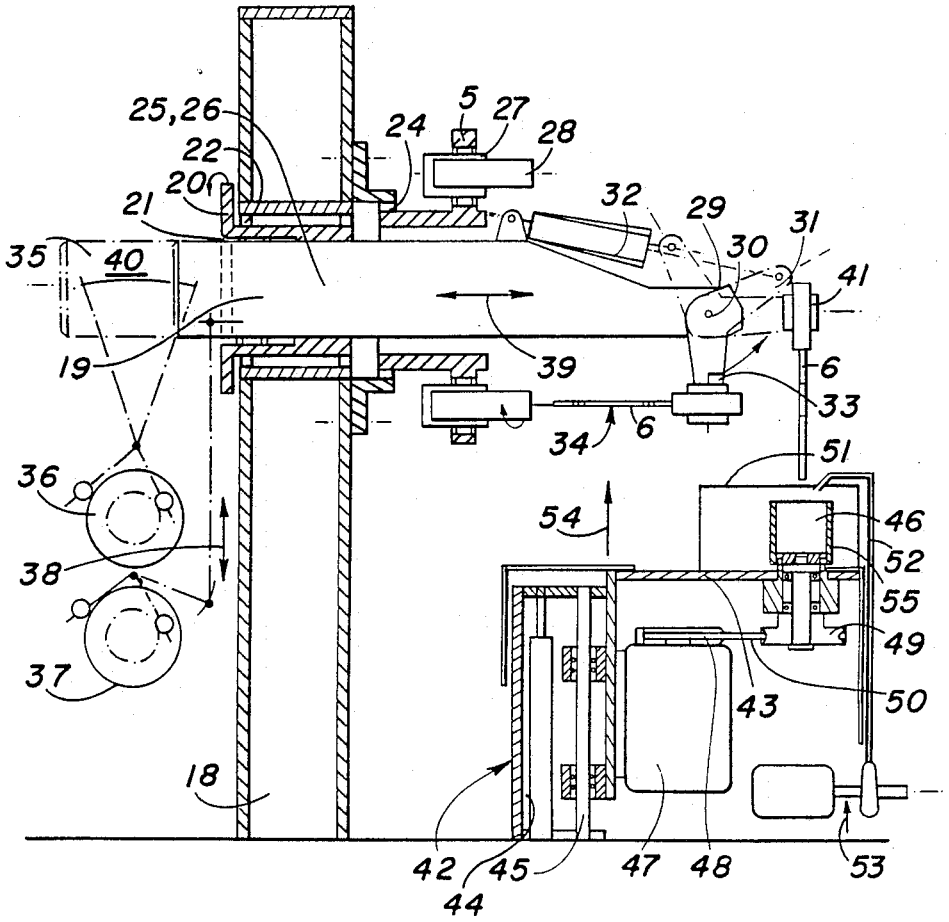
FIG. 3 is a sectional view of the unit for varnishing inside spaces in accordance with the invention.

Referring to the drawings in particular the invention embodied therein comprises a method of spraying the interior of articles such as hollow cans with a coating such as a varnish. As best seen in FIG. 3, the articles 28 are arranged on a drum 5 and nozzles 6 are mounted on a pivot lever 31 carried on a shiftable mounting device 19 in a manner such that the nozzles may be positioned to extend parallel to the axis of the hollow bodies 28 to cause the nozzle 6 to enter into the article and move along its interior and spray the article as the relative movement is carried out. In the embodiment shown in FIG. 3, the nozzle 6 is mounted on the shiftable mounting device 19 which moves backwardly and forwardly in the directions of the arrow 39. In accordance with the invention the nozzles 6 are also mounted so they may be shifted with the lever 31 through an angle so as to position them so that the nozzle axis is aligned with the axis of a cleaning device 46. Relative movement is effected between the cleaning device 46 and the nozzles 6 in the cleaning position, for example such as by raising a lifting table 43 so as to cause the nozzle to enter into the cleaning element or device 46.

Figure 1:
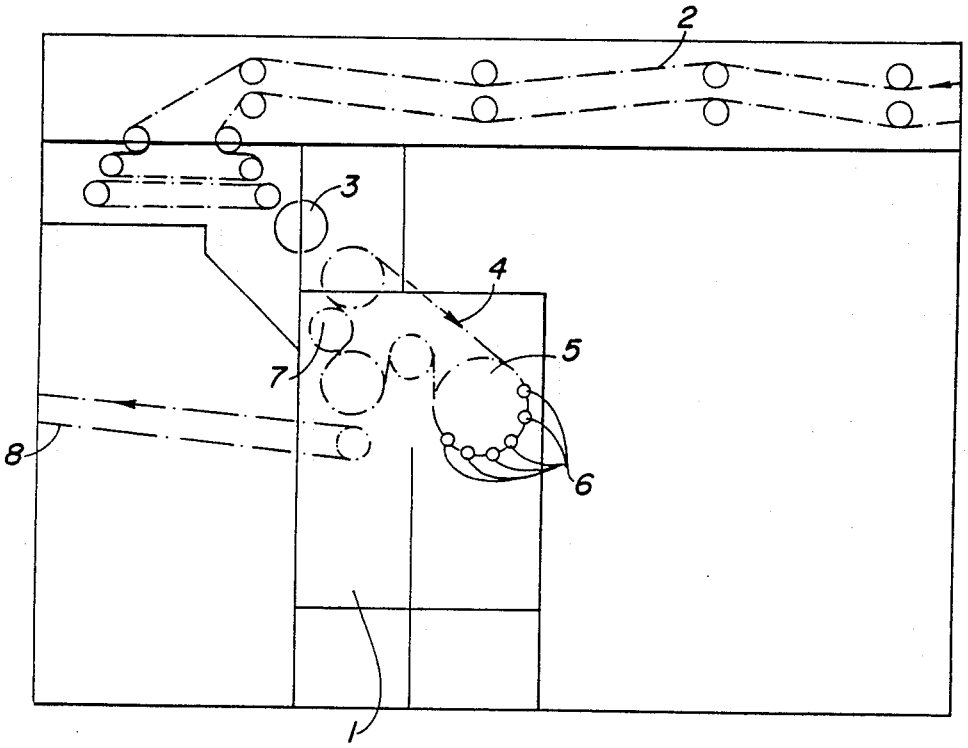
FIG. 1 is a schematic representation of an installation for varnishing the inside of hollow bodies constructed in accordance with the invention.

In the case of the installations for varnishing inside enclosures or spaces 1, represented in FIG. 1, the hollow bodies to be treated are lead continuously to a delivery station 3 by means of a conveyor system, the delivery station giving them to a transport system 4. The transport system 4 brings the hollow bodies to the revolving drum 5, which leads the hollow bodies past the spraying nozzles 6, disposed for varnishing from inside. The nozzles 6 are arranged below the axis of rotation 25 (FIG. 3) of the revolving drum 5. After this the hollow bodies, varnished inside, are lead on the transport system 4 into a take-off station 7, which brings the hollow bodies to a guiding ways system 8.

Figure 2:
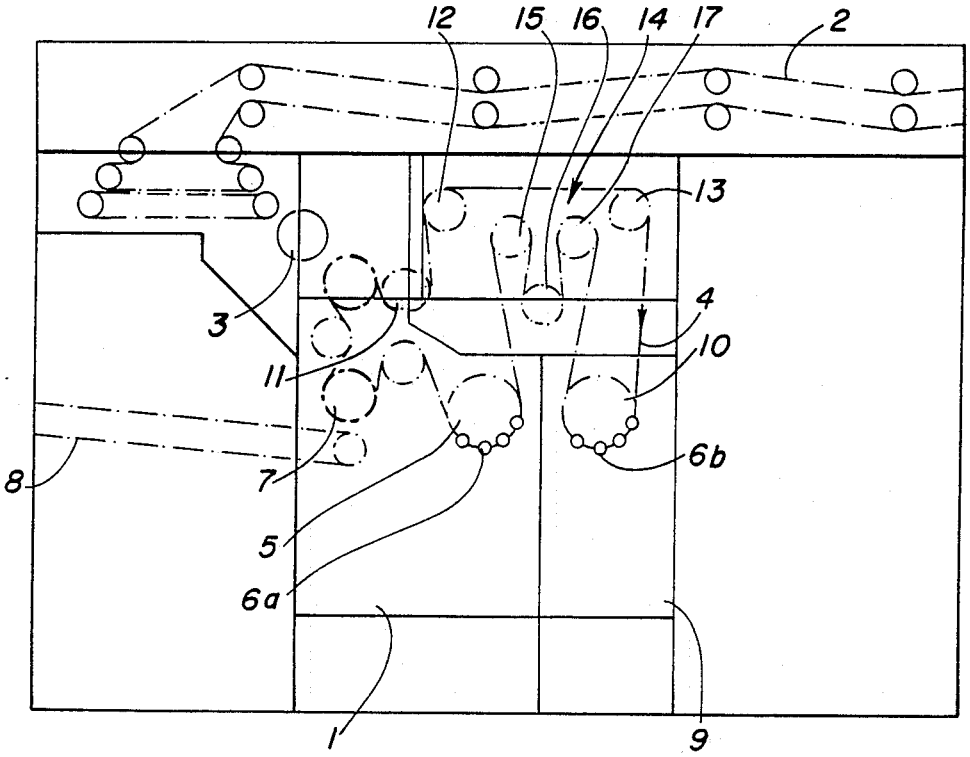
FIG. 2 is a schematic view of an installation for varnishing hollow bodies from inside an intermediate drying between applications.

FIG. 2 shows a further embodiment of an arrangement for varnishing hollow bodies from inside. Here an additional module 9 is coupled to the existing installation for varnishing inside spaces 1, which is composed of a conveyor system 2, a delivery station 3, a transport system 4, a drum 5 which comprises spraying nozzles 6 and a take-off station 7 with a guiding away system 8, the module 9 being composed of a drum 10 three deviating guide rolls 11, 12 and 13 as well as a drying device 14, represented schematically with the rolls 15, 16 and 17.

The transport system is prolonged in such a way, that it can lead the hollow bodies from the delivery station 3 to the drum 10 through the deviating guide rolls 11, 12, and 13, and a first varnishing of the hollow bodies from inside is carried out by the spraying nozzles at the drum 10. After this the transport system 4 runs through the drying device 14 and eventually leads the hollow bodies to the drum 5 comprising the assigned spraying nozzle **6*a*, from where they come to the take-up station 7, which leads the hollow bodies into the guiding away system 8**.

Mostly such installations for varnishing inside spaces are integrated in entire production lines to produce and print tubes for example. If need be here known storage installations are arranged between the individual stations of treatment, which render possible a continuous operation of the entire plant, even if some treating stations have to be switched off individually for a short period of time for example, for purification.

FIG. 3 shows a cross section through a unit for varnishing inside spaces. On a firm support 18 or nozzle support tubular member 19 is disposed slidable in a bearing bushing 20 as a spray nozzles support device. For this purpose the bearing bushing 20 provides axial bearings 21. The bearing bushing 20 for its part is supported through radial bearings 22 in a firm support 18. The drum 5 as well is attached swivable with a radial bearing 24 to the firm support 18. The axis of rotation 25 of the drum 5 coincides with the turning axis 26 of the horizontal axis of member 19. On the drum 5, receiving hollow bodies 27 are disposed swivable for receiving the hollow bodies 28 to be treated. On the side of the horizontal axis of the member 19 turned away from the firm support 18 the spray nozzle support 29 is fixed swivably by means of a joint 30. The support of spray nozzles 29 provides a lever 31 at its upper end, to which a pneumatic cylinder 32 is hinged. The pneumatic cylinder 32 is connected flexibly at its other end with the horizontal axis of the member 19. The spraying nozzles support 29 is equipped for example with four supporting arms 33, each of them carrying a spraying nozzle 6. The supporting arms 33 are disposed in such a way, that the spraying nozzles 6 may be positioned in their horizontal position 34 for varnishing the inside of the hollow bodies 28 and are positioned exactly centrical into the hollow bodies 28.

For varnishing the inside of the hollow bodies 28 the the member 19 is driven to the left (dot-dash line) along its horizontal axis to the position 35, and in the course of this the spraying nozzles 6 are positioned into the hollow bodies 28. This movement, represented by arrow 39, is carried out by a double cam gear 36, which is represented schematically. Since the drum 5 turns continuously, the horizontal axis of the member 19 provides a support of the spraying nozzles 6, this turning movement lasts as long as the spraying nozzles 6 are submerged into the hollow bodies 28. This turning movement, represented by the double arrow 38 receives the horizontal axis of the member 19 as well through a schematically represented double cam gear 37. During the driving of the spraying nozzles 6 out of the hollow bodies 28, which are turning around the proper axis the varnishing of the inside is carried out in the known way. After having driven out the spraying nozzles 6, out of the hollow bodies 28, the horizontal axis 19 returns back into the initial position where the spraying nozzles 6 are submerged into new hollow bodies which are not yet varnished from inside.

In the driven out position 40 of the horizontal axis 19 and thus of the spraying nozzle support 29 the spraying nozzles 6 can be swivelled into the vertical position 41 by the pneumatic cylinder 32.

Below the unit for varnishing inside spaces a purification or cleaning plant 42 is disposed. This purification plant is composed of a lifting table 43, which can be lifted together with a lifting cylinder 44 along a stationary guiding 45 from the position shown in FIG. 3 into an upper position in a direction shown by arrow 54.

On the lifting table 43 rotatable cleaning devices 46 are disposed, which can be driven by a motor 47 comprising belt pulleys 48, 49 and belts 50. The purification devices 46 are surrounded by a collecting container 51. A supply main 52 is connected to a feed pump 53 to supply a cleaning fluid to the device 46.

The lifting table 43 is lifted for the purification of the spraying nozzles 6 which are in a vertical position at 41. The spraying nozzles 6 enters into the purification device 46. A purification material is supplied to each purification plant 46 through the supply main 52, the purification material comes into the collecting container 51 through inlets 55 disposed in the device 46 and then can be lead off. After carrying out the purification process the lifting table 43 is lowered back into the original position, the cleaned spacing nozzles 6 being swivelled back into the horizontal position and the varnishing of inside spaces can be started again.

Figure 4:
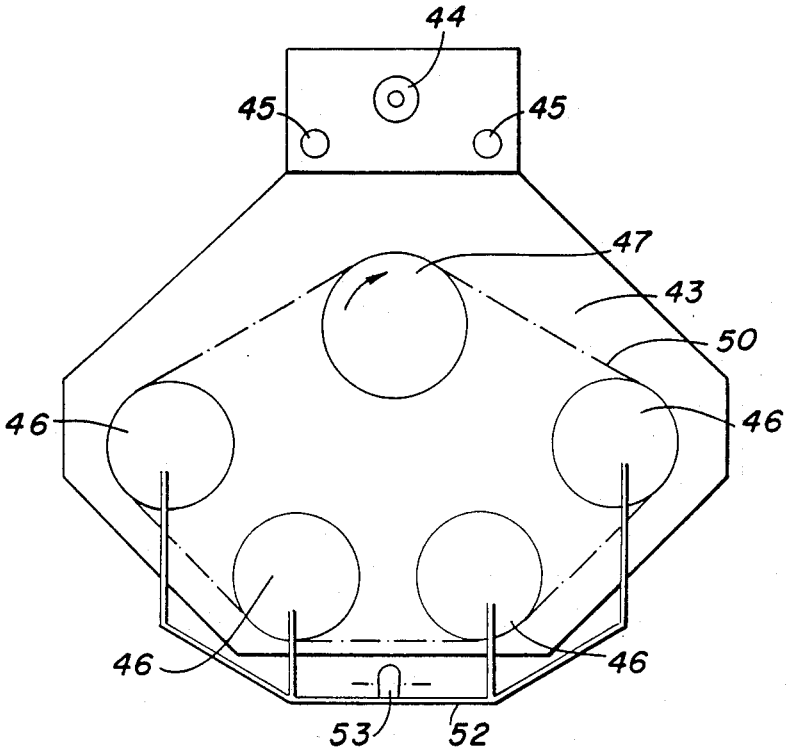
FIG. 4 is a top view of the purification plant of FIG. 3.

FIG. 4 shows a view of the lifting table 43 of the purification installation 46 and each of the spraying nozzles 6 which are in vertical position are directed towards the turning center of a purification device 46. All purification devices 46 are driven by means of the motor 47 and the belt 50. Each purification device 46 has a supply main 52 for the cleaning materials.

Figure 5:
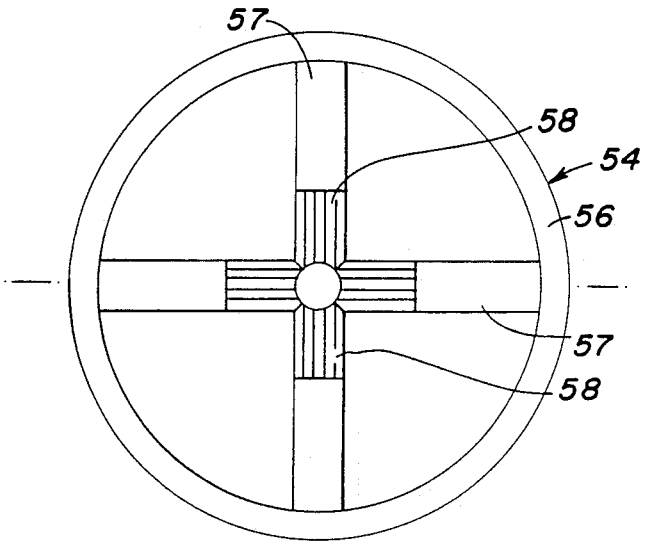
FIG. 5 is a top view of a purification plant.
Figure 6:
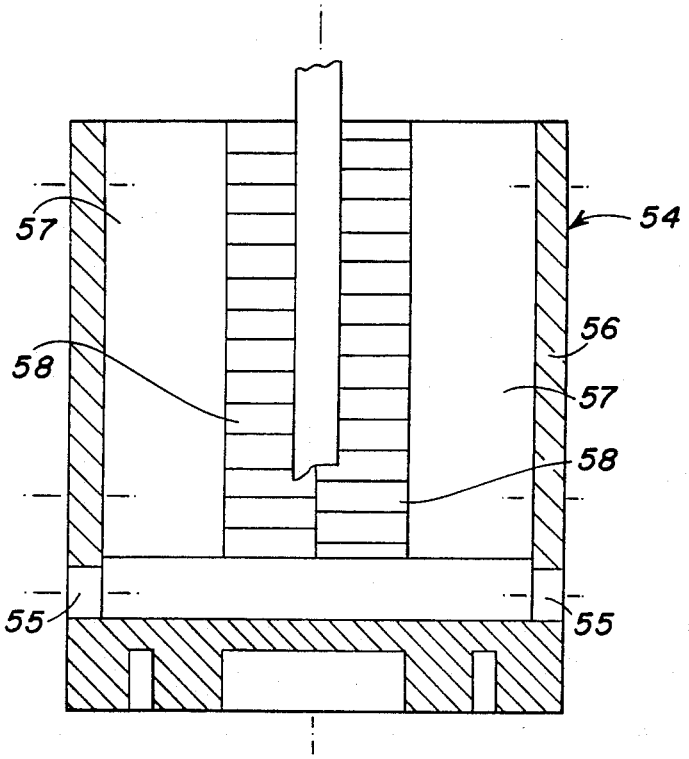
FIG. 6 is a cross-sectional view of the purification plant of FIG. 5.

FIG. 5 and FIG. 6 show that each purification device 46 comprises a container 54 which is open on the top. Below the container 54 provides outlets 55, through which the superfluous purification means can flow off into the collecting container 51" (FIG. 3). At the wall 56 of the container 54 cross pieces 57 are disposed, which are directed against the center of the container 54.

At their ends which are directed towards the center of the container 54, brushes 58 are disposed. The spray nozzle 6 penetrates into the center of the container 54 which is surrounded by the brushes 58, and is freed from the dried rests of varnish by twisting the container 58 and by adding purification means.

The purification process of the spray nozzles 6 can be effected automatically, the processing being operated by a known operating device, and works as described in the following:

The supply of hollow bodies into the drum 5 of the varnishing installation inside spaces is stopped. The hollow bodies supplied by the preceding treatment station come into a known first storage device. The hollow bodies on the drum 5 are treated until the process is finished and are lead over the take-off station 7 into the guiding-away system 8. The following station of treatment receives the hollow bodies through a refilled second storage device. The spraying nozzles 6 provide control elements, such that varnish is sprayed only when a hollow body is on the drum 5. When the drum 5 is empty, the varnishing installation for inside spaces is stopped, that is in such a way, that the horizontal axis 19 is disposed in the drive-out position 40. The spraying nozzles 6, which are in the horizontal position 34 are swivelled into the vertical position 41. The lifting table 43 is lifted, the spraying nozzles 6 submerge into the purification devices 46. These are turned and the spray nozzles 6 are cleaned together by means of a purification mean. Eventually the purification installations 46 are switched off, the lifting table 43 is lowered, the spraying nozzles 6 are swivelled back into horizontal position 40 and the varnishing installation is started again.

When the speed of production is reached, the supply of hollow bodies onto the drum 5 is released and the production carries on. This procedure prevents the quality of the varnish layer from being influenced by differences in the speed when the varnishing installation is braked or started. The intervals for the purification can be chosen freely. The speed of production of the varnishing plant for inside spaces is set in relation to the speed of the other treating stations of the same production line in such a way, that during a purification procedure of the spraying nozzles 6 the first storage device which is connected in series is filled, and the second storage device, connected at the outlet side is cleared out. Between two purification processes the first storage device which is connected in series is cleared out and the second storage device, connected at the outlet side is filled. Thus an uninterrupted working of a production line manufacturing tubes for example is guaranteed.

While specific embodiments of the invention have been shown and described in detail to illustrate the application of the principals of the invention, it will be understood that the invention may be embodied otherwise without departing from such principals.

What is claimed is:

1. A device for spraying material in the interior of hollow bodies which are supplied continuously by a delivery system into a hand-over station of a rotating drum, the hollow bodies, after being coated with the material, are guided into a guiding away system through a receiving head, the device comprising said rotating drum, a spray nozzle supporting mechanism mounted for rotational movement alongside and substantially synchronized with said rotating drum, a plurality of spray nozzles having means for spraying the material therefrom, a pivot joint pivotally mounted on said spray nozzle supporting mechanism and carrying one of said spray nozzles, said pivot joint having means for pivoting said one of said spray nozzles to position said one of said spray nozzles selectively between a first position aligned with a second hollow body to be coated on said rotating drum, and a second position at an angle spaced from the first position, a purification plant located alongside said revolving drum including means for cleaning said spray nozzles, said pivot joint being movable with said one of said spray nozzles to position said one of said spray nozzles into an operative area of said purification plant.

2. A device according to claim 1, wherein said spray nozzles are disposed below an axis of rotation of said drum, said spray nozzles being mounted on said pivot joint for pivotal movement from a horizontal first position to a substantially vertical second position at an angle of substantially 90° relative to said horizontal position.

3. A device according to claim 2, including an adjustment means connected to said pivot joint for adjusting the pivotal motion of said pivot joint.

4. A device according to claim 1, wherein said means for cleaning said spray nozzles comprises a cylindrical member, a lifting table carrying said cylindrical member and being movable upwardly and downwardly toward and away from said nozzle supporting device and being effective to move said cylindrical member into and out of engagement with a nozzle positioned at a spaced location from the first position in which said nozzle is aligned with the hollow body.

5. A device according to claim 4, wherein said cylindrical member has an opened top portion for entry of the nozzle and has brushes therein which clean said nozzle when the nozzle is interengaged with said purification plant, said brushes being arranged to extend radially of an axis of said nozzle during engagement with said nozzle.

6. A device according to claim 5, wherein said purification plant includes a delivery pipe discharging into said cylindrical member.

7. A device for spraying material in the interior of hollow bodies which are supplied continuously by a delivery system into a hand-over station of a rotating drum, the hollow bodies, after being coated with the material, are guided into a guiding away system through a receiving head, the device comprising said rotating drum, a spray nozzle supporting mechanism mounted for rotational movement alongside said drum, a plurality of spray nozzles having means for spraying the varnish therefrom, a pivot joint pivotally mounted on said spray nozzle supporting mechanism and carrying one of said spray nozzles, said pivot joint having means for pivoting said one of said spray nozzles to position said one of said spray nozzles selectively between a first position aligned with a hollow body to be coated and a second position at an angle spaced from the first position, a purification plant located alongside said revolving drum including means for cleaning said spray nozzles, said pivot joint being movable with said one of said spray nozzles to position said one of said spray nozzles into an operative area of said purification plant, said spray nozzles being disposed below an axis of rotation of said drum, said spray nozzles being mounted on said pivot joint for pivotal movement from a horizontal first position to a substantially vertical second position at an angle of substantially 90° relative to said horizontal position, and wherein said means for cleaning said spray nozzles comprises a cylindrical member, a lifting table carrying said cylindrical member and being movable upwardly and downwardly toward and away from said nozzle supporting device and being effective to move said cylindrical member into and out of engagement with a nozzle positioned at a spaced location from the first position in which said nozzle is aligned with the hollow body, and said cylindrical member having an opened top portion for entry of the nozzle and having brushes therein which clean said nozzle when the nozzle is interengaged with said purification plant, said brushes being arranged to extend radially of an axis of said nozzle during engagement with said nozzle.

* * * * *